US008132490B2

(12) United States Patent
Peterson et al.

(10) Patent No.: US 8,132,490 B2
(45) Date of Patent: Mar. 13, 2012

(54) ROTARY TRIMMER

(75) Inventors: Michael E. Peterson, Fairfield, CT (US); P. Y. Gu, Guangzhou (CN); Javier Verdura, Milford, CT (US)

(73) Assignee: Acme United Corporation, Fairfield, CT (US)

( * ) Notice: Subject to any disclaimer, the term of this patent is extended or adjusted under 35 U.S.C. 154(b) by 728 days.

(21) Appl. No.: 12/147,076

(22) Filed: Jun. 26, 2008

(65) Prior Publication Data

US 2009/0000442 A1 Jan. 1, 2009

Related U.S. Application Data

(60) Provisional application No. 60/946,316, filed on Jun. 26, 2007.

(51) Int. Cl.
*B26D 1/18* (2006.01)

(52) U.S. Cl. ..... 83/614; 83/613

(58) Field of Classification Search ..... 83/613, 83/614; D18/34; 108/67, 65, 68, 166
See application file for complete search history.

(56) References Cited

U.S. PATENT DOCUMENTS

| | | | |
|---|---|---|---|
| 417,693 | A | 12/1889 | Wiegand |
| 612,120 | A | 10/1898 | Pierce |
| 745,515 | A | 12/1903 | Perks |
| 791,793 | A | 6/1905 | Johnson |
| 909,227 | A | 1/1909 | Ridgely |
| 957,409 | A | 5/1910 | Brening |
| 1,376,747 | A | 5/1921 | Dorr |
| 3,151,515 | A | 10/1964 | Suverkrop |
| 4,046,044 | A | 9/1977 | Paterson et al. |
| 4,516,452 | A | 5/1985 | Dahle |
| 4,685,366 | A | 8/1987 | Beder |
| 4,967,628 | A | 11/1990 | Judd et al. |
| 5,027,684 | A | 7/1991 | Neukam |

(Continued)

FOREIGN PATENT DOCUMENTS

DE 1743938 U 4/1957

(Continued)

OTHER PUBLICATIONS www.abcoffice.com/carl90; Carl Personal Rotary Trimmer DC-90; 3 pages, 1996-2005.

(Continued)

*Primary Examiner* — Stephen Choi
(74) *Attorney, Agent, or Firm* — Alix, Yale & Ristas, LLP

(57) ABSTRACT

A rotary trimmer for cutting and/or trimming paper and related sheet material is disclosed. The rotary trimmer comprises a trimmer housing having: (i) a first end portion; (ii) a second end portion; and (iii) a cutting platform having: (a) a first platform; (b) a second platform; and (c) a base platform. The first and the second platforms are pivotably connected at least indirectly to (1) the base platform; and/or (2) the first and the second end portions. The rotary trimmer further includes a blade carriage guide disposed between the first and the second end portions and a blade carriage having one or more cutting blades, and slidably mounted to the blade carriage guide wherein the blade carriage can slide along the blade carriage guide to cut and/or trim a sheet or sheet-like material positioned on the cutting platform. A method of using a rotary trimmer is also disclosed.

10 Claims, 10 Drawing Sheets

U.S. PATENT DOCUMENTS

| | | | |
|---|---|---|---|
| D319,840 | S | 9/1991 | Hatsumi et al. |
| 5,069,097 | A | 12/1991 | Mori |
| D322,974 | S | 1/1992 | Mori |
| 5,086,680 | A | 2/1992 | Johnson |
| 5,322,001 | A | 6/1994 | Boda |
| D377,368 | S | 1/1997 | Rellinger |
| D379,193 | S | 5/1997 | Cornell |
| 5,671,647 | A | 9/1997 | Mori |
| D388,819 | S | 1/1998 | Hoen |
| 5,711,077 | A | 1/1998 | Schulz et al. |
| 5,802,942 | A | 9/1998 | Cornell et al. |
| 5,819,618 | A | 10/1998 | Rodriguez |
| D411,227 | S | 6/1999 | Mori |
| D412,716 | S | 8/1999 | Kroger |
| D412,931 | S | 8/1999 | Chan et al. |
| D415,519 | S | 10/1999 | Mori |
| D417,693 | S | 12/1999 | Daley, Jr. |
| 5,996,459 | A | 12/1999 | Cornell et al. |
| D425,548 | S | 5/2000 | Rellinger |
| 6,098,515 | A | 8/2000 | Daley, Jr. |
| 6,460,443 | B1 | 10/2002 | Hsiao |
| D468,343 | S | 1/2003 | Lira-Nunez |
| D469,800 | S | 2/2003 | Robillard |
| 6,540,451 | B1 | 4/2003 | Mori |
| D477,017 | S | 7/2003 | Vossler et al. |
| 6,776,077 | B1 | 8/2004 | Chen |
| 6,786,123 | B1 | 9/2004 | Chen |
| D501,500 | S | 2/2005 | Schultz et al. |
| D503,191 | S | 3/2005 | Mori et al. |
| D528,590 | S | 9/2006 | Bathard et al. |
| D534,204 | S | 12/2006 | Workman et al. |
| D536,367 | S | 2/2007 | Gunter et al. |
| D543,583 | S | 5/2007 | Workman et al. |
| 7,299,731 | B2 | 11/2007 | Schulz |
| D559,304 | S | 1/2008 | Lam et al. |
| D559,307 | S | 1/2008 | Lam et al. |
| 7,743,700 | B2 * | 6/2010 | Ayala et al. ..... 100/176 |
| 2002/0096031 | A1 | 7/2002 | Yang |
| 2003/0010170 | A1 | 1/2003 | Lemens et al. |
| 2003/0140757 | A1 | 7/2003 | Carlson et al. |
| 2003/0140761 | A1 | 7/2003 | Schulz |
| 2003/0154835 | A1 | 8/2003 | Nunez et al. |
| 2003/0165090 | A1 | 9/2003 | Turner et al. |
| 2003/0165091 | A1 | 9/2003 | Kadlec |
| 2004/0149108 | A1 * | 8/2004 | McLean et al. ..... 83/614 |
| 2004/0187318 | A1 | 9/2004 | Mathieu et al. |
| 2004/0216571 | A1 | 11/2004 | Schultz et al. |
| 2004/0226426 | A1 | 11/2004 | Tseng |
| 2005/0028663 | A1 | 2/2005 | Volfson |
| 2005/0034785 | A1 * | 2/2005 | Lovchik et al. ..... 144/356 |
| 2005/0109180 | A1 | 5/2005 | Schultz et al. |
| 2005/0199116 | A1 | 9/2005 | Loibl |

FOREIGN PATENT DOCUMENTS

| | | | |
|---|---|---|---|
| DE | 4209778 | A1 | 1/1993 |
| DE | 20207589 | U1 | 9/2002 |
| EP | 0893212 | A2 | 1/1999 |
| EP | 0933172 | | 1/1999 |
| FR | 2724340 | | 9/1994 |
| GB | 1143254 | | 10/1966 |
| GB | 2040207 | A | 8/1980 |
| GB | 2264667 | | 9/1993 |
| GB | 2276111 | | 9/1994 |
| JP | 05337879 | | 12/1993 |
| KR | 200428871 | Y1 | 10/2006 |
| WO | 9958305 | | 11/1999 |

OTHER PUBLICATIONS

Yamada Koichi Azuma Nobutaka; Dynamic Analysis of the Rotary Shear Shredder; http://sciencelinks.jp; Abstract only; Hitachi Zosen Technical Review; vol. 61, No. 1, p. 41-45. 2000, Japan.

* cited by examiner

2

22
4
34
34
32
32
8
72
10
72
36
36
30
30
12
34
34
22
4

ROTARY TRIMMER

CROSS REFERENCE TO RELATED APPLICATIONS

This application is related to design patent application Ser. No. 29/281,584 for TRIMMER filed on Jun. 26, 2007, which is hereby incorporated by reference in its entirety, and further claims priority to provisional patent application No. 60/946,316, entitled "Trimmer" and filed on Jun. 26, 2007, the entirety of which is incorporated by reference herein.

FIELD OF THE INVENTION

The present invention relates to trimmers and, more particularly, to rotary trimmers for cutting paper and related sheet or sheet-like material.

BACKGROUND OF THE INVENTION

Devices for cutting and/or trimming sheet or sheet-like material including, for example, paper, cloth, wallpaper and the like are well known in the art. A variety of trimmers, including anvil and rotary type trimmers are commonly available and frequently employed for cutting and/or trimming the aforementioned materials. For example, a rotary trimmer is disclosed in U.S. patent application Ser. No. 10/695,429, titled "Rotary Trimmer" and filed on Oct. 28, 2003, which is incorporated by reference herein in its entirety.

Conventional trimmers, and particularly rotary style trimmers, are often inadequate in at least some aspects. Specifically, the conventional trimmers available in the market today are generally often expensive to own, occupy a large working space (both during storage and operation), and/or are difficult to transport. A need therefore exists for a versatile trimmer that would overcome these shortcomings.

It would be advantageous if a rotary trimmer that is space-efficient, cost-efficient and light weight is developed. It would additionally be advantageous if such a trimmer that, while providing a relatively large working surface, would additionally provide an efficient cutting/trimming operation. It would further be advantageous if the trimmer was portable and convenient to stow away and in addition had readily interchangeable blades.

BRIEF SUMMARY OF THE INVENTION

In one aspect, the present invention relates to a rotary trimmer. In accordance with at least some embodiments, the rotary trimmer comprises a trimmer housing having: (i) a first end portion; (ii) a second end portion; and (iii) a cutting platform having: (a) a first platform; (b) a second platform; and (c) a base platform connected at least indirectly to at least one of the first and the second end portions, with the first and the second platforms pivotably connected at least indirectly to (1) the base platform; and/or (2) the first and the second end portions. The rotary trimmer further includes a blade carriage guide disposed between the first and the second end portions and a blade carriage having one or more cutting blades, the blade carriage slidably mounted to the blade carriage guide wherein the blade carriage can slide along the blade carriage guide to cut and/or trim a sheet or sheet-like material positioned on the cutting platform In another aspect, the present invention relates to a method of using a rotary trimmer. In accordance with at least some embodiments, the method comprises: providing a trimmer housing, the housing having: (i) a first end portion; (ii) a second end portion; and (iii) a cutting platform having: (a) a first platform; (b) a second platform; and (c) a base platform connected at least indirectly to at least one of the first and the second end portions, with the first and the second platforms pivotably connected at least indirectly to (1) the base platform; and/or (2) the first and the second end portions; and a blade carriage having one or more cutting blades, the blade carriage slidably mounted to the blade carriage guide. The method additionally comprises pivotably moving at least one of the first and the second platforms to obtain one of a working configuration and a storage configuration.

In yet another aspect, the present invention relates to a rotary trimmer comprising a trimmer housing, the housing having: (i) a first end portion; (ii) a second end portion; and (iii) a cutting platform having: (a) a first platform; (b) a second platform; and (c) a base platform connected at least indirectly to at least one of the first and the second end portions, with the first and the second platforms pivotably connected at least indirectly to (1) the base platform; and/or (2) the first and the second end portions.

In another aspect, the present invention relates to a method of unfolding a trimmer housing of a rotary trimmer. The method comprises providing a trimmer housing, the housing having: (i) a first end portion; (ii) a second end portion; and (iii) a cutting platform having: (a) a first platform; (b) a second platform; and (c) a base platform connected at least indirectly to at least one of the first and the second end portions, with the first and the second platforms pivotably connected at least indirectly to (1) the base platform; and/or (2) the first and the second end portions. The method additionally comprises unfolding at least one of the first and the second platforms to obtain one of a working configuration and a storage configuration of the trimmer.

Other aspects and embodiments are contemplated and considered within the scope of the invention.

BRIEF DESCRIPTION OF THE DRAWINGS

Embodiments of the invention are disclosed with reference to the accompanying drawings and these embodiments are provided for illustrative purposes only. The invention is not limited in its application to the details of construction or the arrangement of the components illustrated in the drawings. Rather, the invention includes other embodiments and/or can be practiced or carried out in other various ways. The drawings illustrate a best mode presently contemplated for carrying out the invention. Like reference numerals are used to indicate like components. In the drawings.

DETAILED DESCRIPTION OF THE INVENTION

Figure 1:
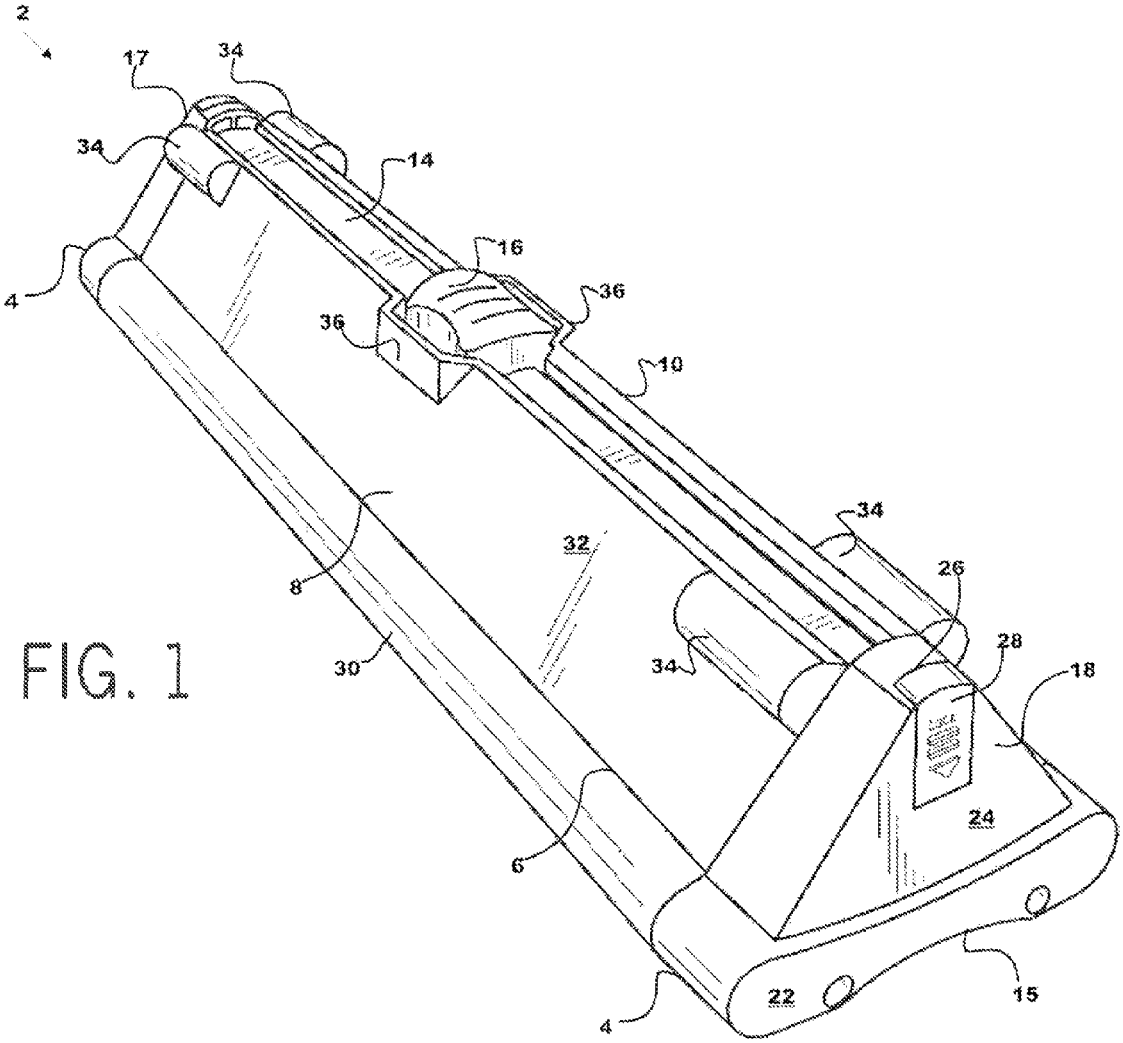
FIG. 1 is a perspective view of a rotary trimmer showing a trimmer housing in a storage configuration, the trimmer housing having first and second platforms pivotably attached to end portions of the trimmer housing, in accordance with at least some embodiments of the present invention.
Figure 2:
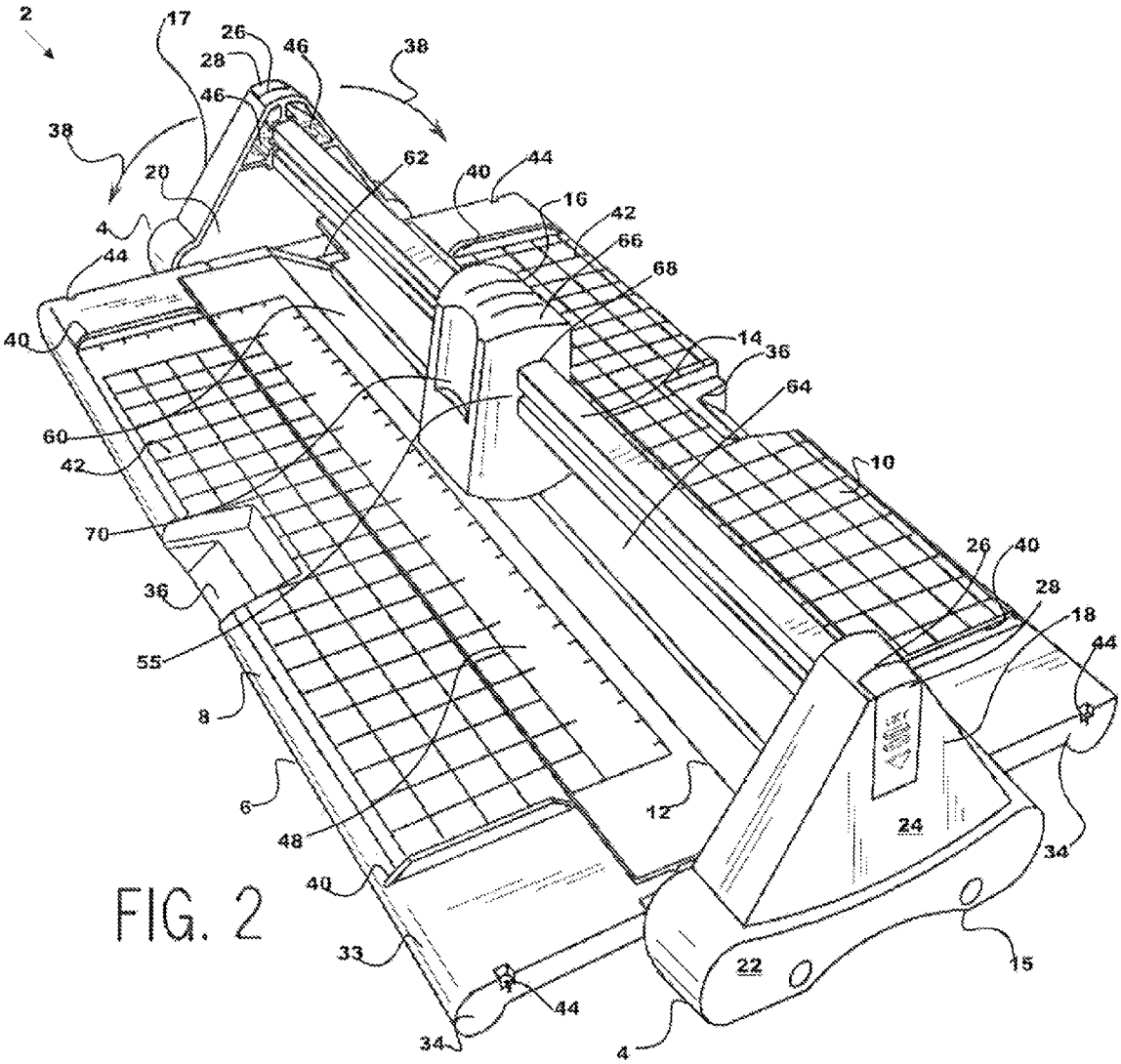
FIG. 2 is a perspective view of the rotary trimmer of FIG. 1 in a working configuration, additionally illustrating a blade carriage attached to a blade carriage guide, in accordance with at least some embodiments of the present invention.
Figure 3:
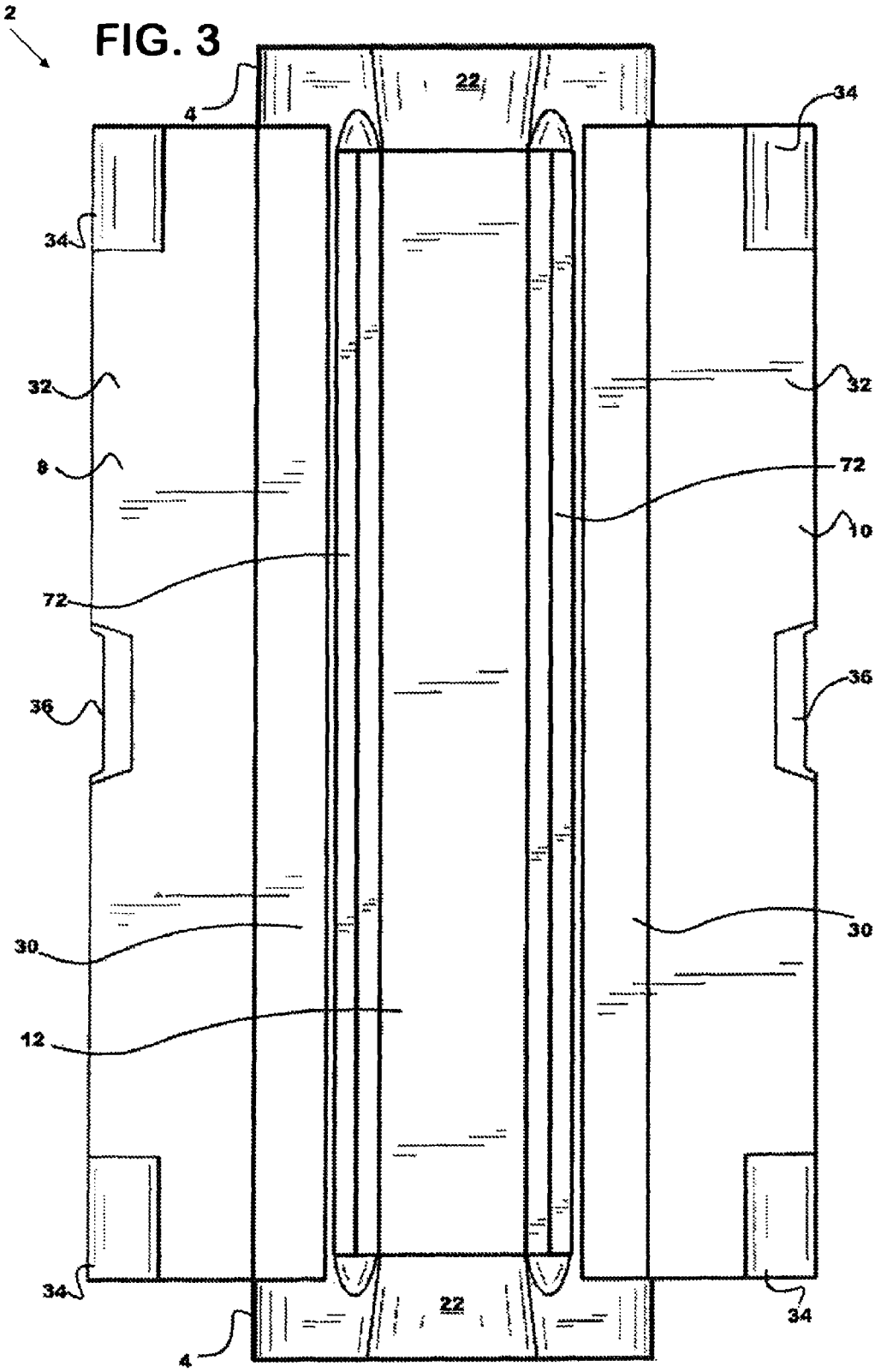
FIG. 3 is a bottom plan view of the rotary trimmer of FIG. 2, in accordance with at least some embodiments of the present invention.
Figure 4:
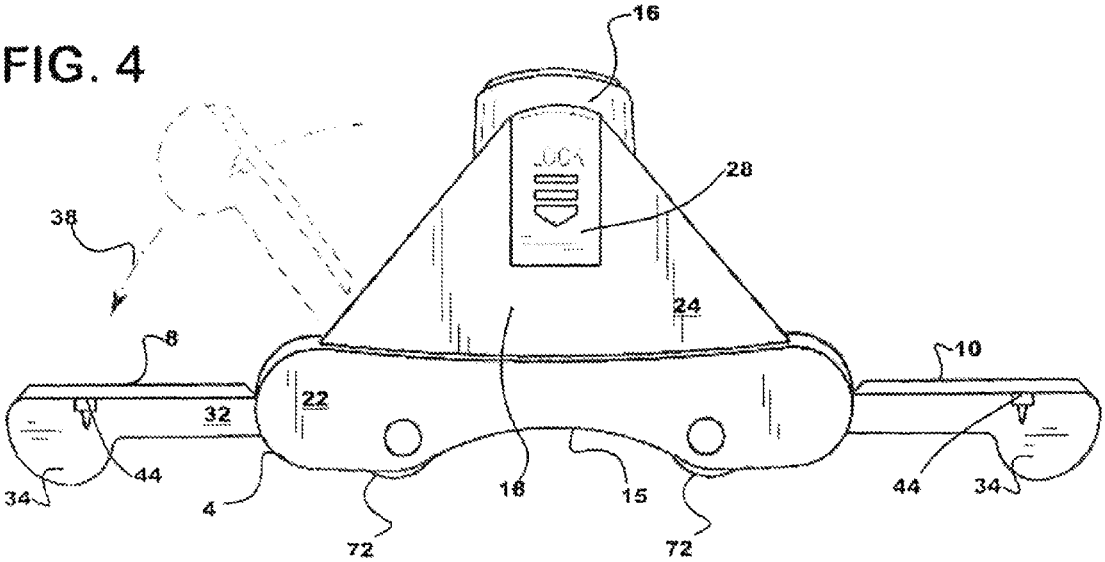
FIG. 4 is an end view of the rotary trimmer of FIG. 1, showing angular motion of the first platform, the angular motion representative of a transition from the storage configuration of FIG. 1 to the working configuration of FIG. 2, in accordance with at least some embodiments of the present invention.
Figure 5:
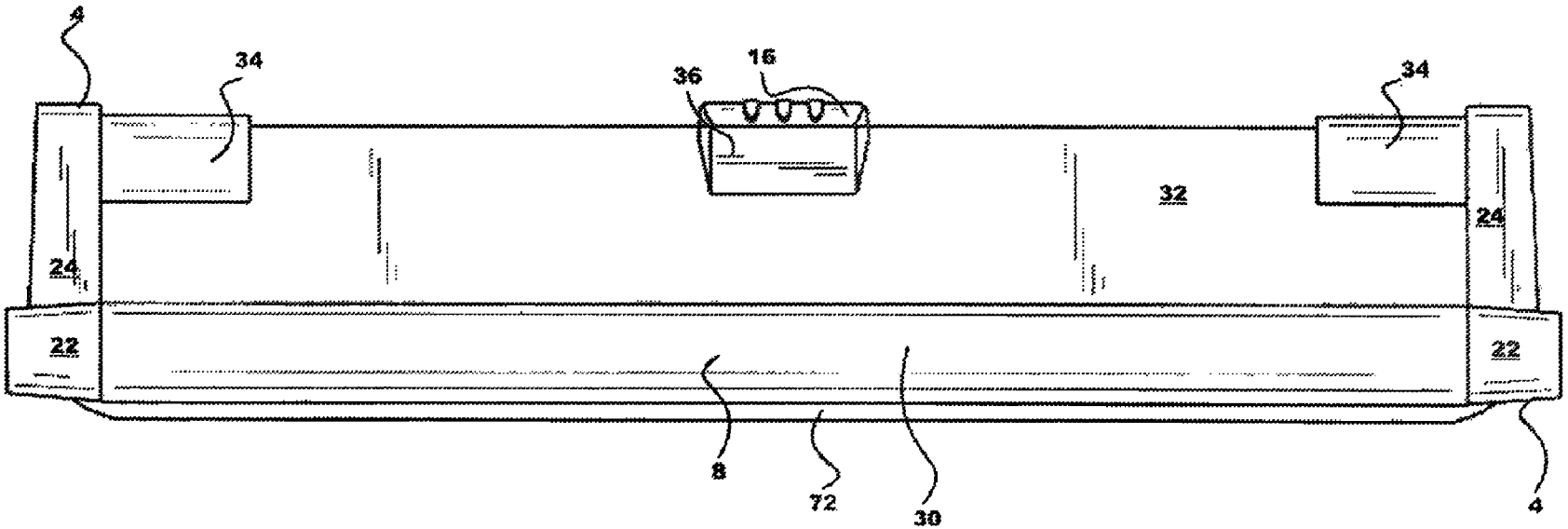
FIG. 5 is a side view of the storage configuration of the rotary trimmer of FIG. 1, illustrating the first and the second platforms folded together with the blade carriage protruding therefrom, in accordance with at least some embodiments of the present invention.
Figure 6:
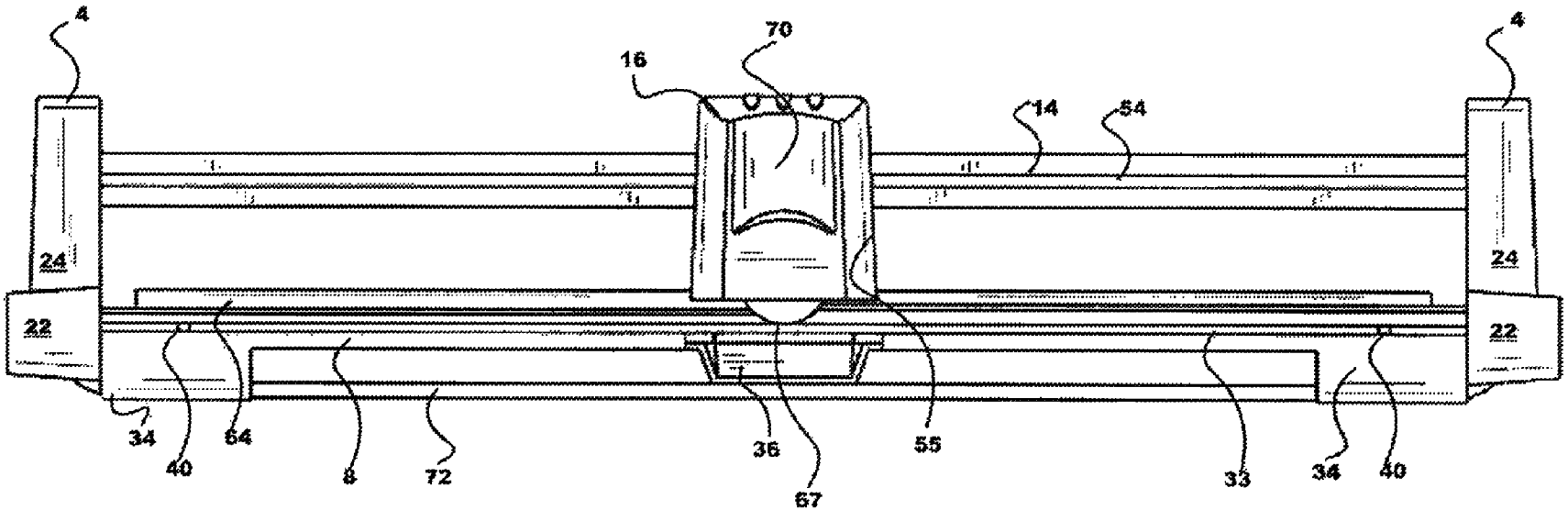
FIG. 6 is a side view of the working configuration of the rotary trimmer of FIG. 2, in accordance with at least some embodiments of the present invention.

Referring to FIGS. 1-6, several views of an exemplary rotary trimmer 2 are shown in accordance with at least some embodiments of the present invention. In particular, FIG. 1 shows a perspective view of the rotary trimmer 2 in a storage configuration, while FIG. 2 shows the rotary trimmer in a working configuration. Similarly, FIGS. 3 and 4 are bottom and end views, respectively, of the rotary trimmer 2. Additionally, FIGS. 5 and 6 illustrate respective side views of FIGS. 1 and 2.

Referring generally to FIGS. 1-6 and particularly to FIGS. 1 and 2, the rotary trimmer 2 includes a trimmer housing 4 having a cutting platform 6. The cutting platform 6 in turn includes a first side platform 8, a second side platform 10 and a central or base platform 12. In at least some embodiments, the first and the second platforms 8 and 10, respectively, are pivotably (also referred to as pivotally) connected to the trimmer housing 4 and the central platform 12 (See FIG. 2), albeit in alternative embodiments, the platforms 8, 10 can be pivotably attached to either one of the housing or the central platform. It is noted that the term "platform" can encompass any platform-like structure and can generally also include a platform portion, a platform section and the like. In accordance with at least some embodiments of the invention, the pivot connection can include a male protrusion component and a female receiving aperture positioned in mating alignment with one another for pivoting. In other embodiments, alternative pivotable connections that are readily available to one skilled in the art and frequently employed can be used as well.

Additionally, the rotary trimmer 2 includes a blade carriage guide 14 (or blade carriage rail guide, carriage guide, blade carriage guide and the like) operatively connected to the trimmer housing 4 (in a manner described below). As shown, the blade carriage guide is positioned above and extends parallel or substantially parallel to the cutting platform 6. The blade carriage guide 14, in the present embodiment, extends over substantially the entire length of the rotary trimmer 2 and is positioned over and parallel to the base platform 12. Notwithstanding the particular arrangement of the blade carriage guide 14 described and shown in the present embodiment, in other embodiments, the positioning, size and/or shape of the blade carriage guide can vary to convenience. Further, a blade carriage 16 is slidably mounted on to the blade carriage guide 14. In this fashion, the blade carriage 16 can move along a pre-defined cutting path to perform or accomplish a trimming (e.g., scoring) and/or cutting (e.g., shearing) operation on a sheet or sheet-like material (as described further below).

Referring still to FIGS. 1-6 and particularly to FIGS. 1 and 2, the trimmer housing 4 serves as a supporting frame for the rotary trimmer 2 and additionally includes two end portions 15 and 17, each of which has a generally triangular profile. In general, the end portions 15 and 17 are disposed on opposing ends of the cutting platform 6 and more particularly, on the opposing ends of the base platform 12. In at least some embodiments, the end portions 15 and 17 can each have a width that is the same or similar to the width of the base platform 12, although this too can vary in other alternative embodiments. Furthermore, other shapes and profiles including, both geometric and non-geometric profiles, for the end portions 15 and 17 are contemplated and considered within the scope of the present invention.

Each of the end portions 15 and 17 further includes an outer portion 18 facing away from the cutting platform 6, as well as a hollow or at least partially hollow inner portion 20 (See FIG. 2) that is open and faces towards the cutting platform. In addition, each of the end portions 15 and 17 includes a base portion 22 for supporting the rotary trimmer 2 and to which are connected the first, second and the base platforms 8, 10 and 12, respectively, and a top portion 24 for connecting the blade carriage guide 14 to the trimmer housing 4. In at least some embodiments, the base portion 22 and the top portion 24 can be integrally molded as a single piece of plastic. In other embodiments, other durable and rigid (or semi-rigid) materials such as wood, aluminum or steel, or other suitable materials can be employed for constructing each of the base and the top portions 22 and 24, respectively. Furthermore, in at least some embodiments, the base portion 22 and the top portion 24 can be separate (or multiple) pieces connected together in operational association. In at least some other embodiments, each of the base portion 22 and the top portion 24 can be made of same or alternatively different materials. Further, the outer portion 18 of each of the respective end portions 15 and 17 has a cut-out 26 formed on the top portion 24 for frictionally receiving a locking pin 28 therein. In at least some embodiments and as shown, the cut-out 26 can be substantially rectangular, although other profiles of the cut-out corresponding to the locking pin 28 are contemplated and considered within the scope of the present invention. At least a portion of the cut-out 26 extends inwards toward the inner surface 20 for receiving the blade carriage guide 14 therein, which is then secured by the locking pin 28 on the outer portion 18, the details of which are described with respect to FIG. 7 below.

Thus, as shown, the rotary trimmer 2 has a triangular or triangular-like shape or profile when viewed from an end perspective (See FIG. 4). Though the trimmer housing 4 is substantially triangular or triangular-like in shape, other shapes, sizes and configurations are contemplated by varying the dimensions of the rotary trimmer 2, including varying the dimensions, shapes and sizes of each of the platforms 8, 10 and 12. The first and the second platforms 8 and 10, respectively, which are pivotably (e.g., hingedly) or at least partially rotatably connected to the end portions 15 and 17 and also to the central platform 12 in some embodiments, provide a flat, co-planar and stable working platform for cutting and/or trimming paper or other related sheet like material.

With additional reference to the cutting platform 6 in FIGS. 1 and 2, each of the first and the second platforms 8 and 10, respectively, includes an exterior (or bottom) surface 32 and an inner (or top) working surface 33. The bottom surface 32 additionally includes a curvilinear portion 30 adjacent the base platform 12 and a pair of fixed, substantially curvilinear supports (or side supports) 34, with one on each outer lateral edge of the first and the second platforms 8 and 10, respectively, and disposed distally from the base platform. The curvilinear portion 30 on the bottom surface 32 extends substantially the entire length of the first and the second platforms 8 and 10, respectively, and proximal to the base platform 12 of the trimmer housing 4. The exterior (or bottom) surface 32 is rigid and provides structural integrity to the trimmer 2, while the supports 34 provide stability to the rotary trimmer 2 during the cutting (and/or trimming) operation. The shape, size, orientation and number of the supports 34 can vary in other embodiments. For example, in alternative embodiments, greater than two side supports or a single side support is conceived. In yet another alternative embodiment, the supports 34 can be adjustable to rest on uneven surfaces and of a variety of shapes and sizes. It is further contemplated that a variety of non-slip surface treatments, including rubber treatments, can be added to the supports 34. Alternatively, the supports 34 can be formed from a non-slip material. In yet other embodiments, the supports 34 need not be integrally formed with the bottom surface 32 of the first and the second platforms but rather, can be separately formed and connected to one another.

Additionally, centrally located along the length of the first and the second platforms 8, 10, respectively, are notches 36 extending from the top surface 33 to form projections on the bottom surface 32 for serving to at least partially house the blade carriage 16 during storage and transport. As shown and in accordance with at least some embodiments, the notches 36 can be rectangular in shape. The central location of the notches 36 provides for easy opening of the rotary trimmer 2 while avoiding wear and tear of a cutting blade 67 (See FIG. 6) due to undesirable movement of the blade carriage 16. The notches 36 additionally serve as handles for gripping the rotary trimmer during transportation or stowing. The notches 36 prevent or substantially prevent movement of the blade carriage when the rotary trimmer (or possibly even the blade carriage) is in an inoperative position. The notches 36 are dimensioned appropriately to substantially encompass the length of the blade carriage 16. Additionally, in the present embodiment, the top of the blade carriage 16 extends above the notches 36 in the storage configuration as seen in a side view of FIG. 5. In at least some alternative embodiments, the blade carriage 16 can be flush with the notches 36, or can alternatively be lower than the notches 36. Notwithstanding the fact that in the present embodiment, the rectangular notches 36 are located centrally along the lateral edge of the first and second platforms 8, 10, in other embodiments, these notches can be positioned in any desired location along the length of the first and second platforms 8, 10.

The arrangement of the first and second platforms 8, 10 in the closed or storage configuration (See FIG. 1) provides an easy and convenient trimmer for storage and portability. As mentioned earlier, although the present embodiment provides for a substantially triangularly-profiled storage configuration, other shapes, sizes and orientations of the various components can vary to convenience. It is also noted that, in at least some embodiments, the trimmer housing 4 and the first and second platforms 8 and 10 can all be made of molded plastic providing a light-weight and cost-efficient rotary trimmer 2, while in alternative embodiments, other materials including wood and metals (e.g., aluminum) can be used. To provide a cutting/trimming function, the rotary trimmer 2 of FIG. 1 is used in a working configuration as described in more detail in regards with FIG. 2.

Referring still to FIGS. 1-6 and particularly to FIG. 2, the rotary trimmer 2 is shown in a working or open configuration. By virtue of being pivotably attached to the trimmer housing 4, the first and second platforms 8, 10 are capable of movement along a pre-defined path. For example, to operate the rotary trimmer in the working configuration, the first and second platforms 8, 10 can be grasped by a user at notches 36 and pulled (e.g., pivoted or rotated) by the user outwardly (to form an angle of for example, 180 degrees with the central platform 12) in a direction indicated by arrows 38 as shown in FIG. 4. Rotation or pivoting of the platforms 8, 10 will generally continue until the side supports 34 rest on a supporting surface (e.g., table, counter, desk, etc.). In this fashion, platforms 8 and 10 serve to provide a flat and contiguous working surface for the material to be cut and/or/trimmed. Relatedly, to obtain the storage and/or portable configuration, the platforms 8 and 10 can be pivoted (or rotated) about the pivot connection towards the blade carriage guide 14 until the platforms form a 30 degrees or substantially 30 degrees angle with a vertical plane or an angle of 60 or substantially 60 degrees with a horizontal plane. In at least some embodiments, the rotary trimmer 2 can have a portable and/or a storage configuration in which each of the first and the second platforms 8 and 10, respectively, can form an angle of about 30 degrees to about 60 degrees with respect to the base platform 12. Furthermore, each side platform is capable of being operated individually irrespective of the other side platform. This provides a substantial advantage over conventional trimmers which do not have such capability, particularly when a trimmer is used in an environment have substantial space restrictions. In alternative embodiments (although not shown), the platform surfaces 33 can be slidably or otherwise extended outwardly past the supports 34, thereby achieving a larger (e.g., an extended) working platform while accommodating space limitations and additionally maintaining a substantially flat working surface.

In the working configuration as seen in FIG. 2, each of the first and second platforms 8, 10 has located on its upper surface paper stops 40 for preventing or minimizing movement (e.g., slippage) of the sheet or sheet-like material to be cut. As shown, each of the side platforms 8 and 10 respectively, has two paper guides or stops 40, one on each side of the platform 6. The paper stops extend substantially perpendicular to the cutting platform 6 and the length between the two paper stops 40 can either be adjusted or be in a fixed configuration. In an alternative embodiment, additional paper guides 40 can be provided. Between the paper stops 40, an aluminum insert can be provided on which a graduated metric units and/or English units 42 to aid the user in aligning and measuring the sheet material to be cut can be inscribed. Subsequent to operation, the rotary trimmer can be restored back to the storage configuration by pivoting the first and the second platforms 8 and 10 along the pre-defined path to frictionally engage notches 44 with protrusions 46 present on the inner surface 20 of the end portions 15 and 17.

With respect to the central platform 12 in particular, it is located in between the first and the second platforms 8 and 10, respectively, and is fixedly attached to the trimmer housing 4, although in other embodiments, the base platform may be pivotably attached as well. The central platform 12 serves as the main cutting board and is generally made of a rigid metal (e.g., aluminum) to prevent the platform from being damaged by the sharp edges of the cutting blade. However, in other embodiments, other metals or rigid materials can potentially be used. The central portion is substantially rectangular in shape, similar to the first and second platforms 8, 10. The three platforms, that is, the central platform 12 and the first and second platforms 8, 10, provide a contiguous (or substantially contiguous), co-planar (or substantially co-planar) working area for securing paper or sheet material. Additionally, the base platform 12 has inscribed thereon graduated metric units and/or English units 48 similar to the inscriptions 42 on the first and the second platforms 8 and 10, respectively. Grids of varying sizes or other measuring aids can also be present. Further, the inscriptions can be present on the entire cutting platform, or on a portion thereof. Attached to the central platform 12 via the trimmer housing 4 is the removable blade carriage guide 14, which is positioned above and parallel to the central platform. The blade carriage guide 14 in the present embodiment is made up of a light-weight metal (e.g., aluminum) although other materials including plastic can be used in other embodiments.

Figure 7:
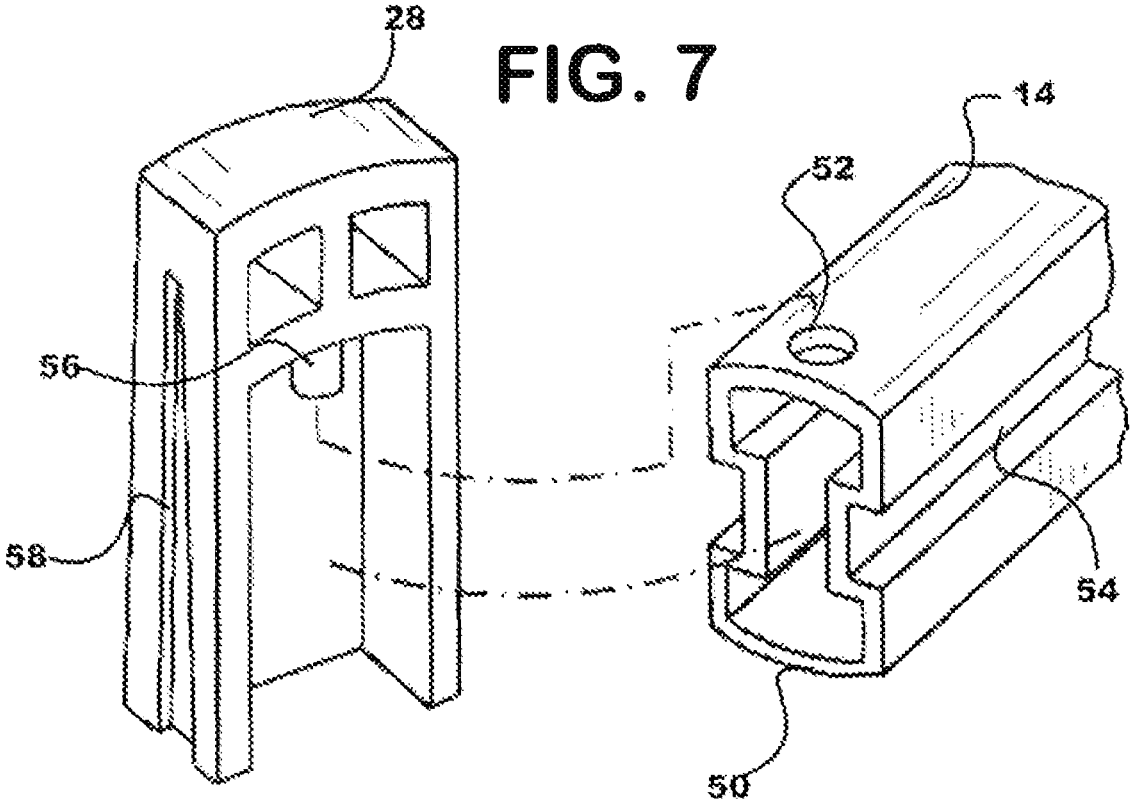
FIG. 7 is an exploded view of an end portion of the blade carriage guide showing a locking mechanism for engaging the blade carriage guide to the trimmer housing by way of one or more locking pins, in accordance with at least some embodiments of the present invention.

Referring now to FIG. 7 in conjunction with FIGS. 1-6, an exploded view of an end portion of the blade carriage guide 14 and the manner of connecting the blade carriage guide to the end portions 15 and 17 of the trimmer housing 4 by way of the locking pins 28 is shown, in accordance with at least some embodiments of the present invention. As shown, the blade carriage guide 14 is a hollow rectangular rod mounted to the trimmer housing 4 for providing a surface along which the blade carriage 16 can slide. Such a surface is provided by way of indented grooves 54 on both sides of the blade carriage guide 14 to slidably mount the blade carriage 16 along which the blade carriage can be slid in between the two end portions 15 and 17 in the working configuration. Notwithstanding the fact that the blade carriage guide 14 is a hollow rod in the present embodiment, this need not always be the case. Rather, in other embodiments, the blade carriage guide 14 can be a solid rod having the grooves 54 or other similar structures for sliding the blade carriage 16.

Further, the blade carriage guide 14 is removably attached on both its end sections to the trimmer housing 4 by way of the locking pins 28 thereby allowing the blade carriage guide and hence the blade carriage 16 to be removed and/or replaced. In particular, a portion of an end section 50 of the blade carriage guide 14 is inserted within the notch 26 on the inner surface 20 of the end portions 15 and 17 and is secured on the outer surface 18 by way of the locking pin 28. To secure the blade carriage guide 14 in position, the end section 50 of the blade carriage guide 14 has a small hole 52, within which a protrusion 56 of the locking pin 28 can frictionally fit as shown by the dotted lines in FIG. 7. The locking pin 48 is generally rectangular in shape with indentations 58 on its side surfaces for slidably engaging the blade carriage guide 14 to the trimmer housing 4. The manner in which the blade carriage guide is locked can vary. For example, in other embodiments, male/female connectors or other locking mechanisms can be used.

Turning back to FIGS. 1-6 and particularly to FIG. 2, in accordance with at least some embodiments, and as shown, centrally located on one side of the blade carriage guide 14 along the length on the top surface of the central portion 12 is a slightly graduated (or slanted or angled) portion 60. The angling (or slant) of the graduated portion 60 can vary to convenience, but in any event, it will be sufficient to facilitate cutting and/or trimming. On the other side of the blade carriage guide 14 and abutting the graduated portion 60 on the central platform 12 is located a strike bar 62. The strike bar 62, typically made of a metal extends partially beneath the blade carriage 16 and aids the cutting operation. The strike bar 62 has a sharp edge in the present embodiment along which a cutting blade located within the blade carriage 16 closely slides. The sliding motion of the blade 67 with respect to the strike bar 62 creates a trimming and/or cutting action, which allows for an accurate trimming and/or cutting of the sheet like material, including many types of paper. In other embodiments, the sharp edge of the strike bar 62 can be replaced by a cutting edge having a cutting profile similar to the cutting blade. In alternate embodiments, the strike bar 62 can be present on both sides of the blade carriage guide 14 (in place of the graduated portion 60) on the central platform 12.

Also located above the strike bar 62 is a see through paper guide 64, which aids in securing paper or other material to be cut on the cutting platform 6. For example, paper can be inserted between a bottom surface of the paper guide and a top surface of the strike bar 62 to secure the paper in position. The paper guide is secured to the strike bar 62 and also to the end portions 15 and 17, and particularly, the inner surface 20 of the end portions 15, 17 of the trimmer housing 4 by way of slots formed on the inner surface within which the end section of the paper guide can slide through. By virtue of the paper guide being secured by a slot, it can easily be replaced when worn. The paper guide 64 is shown only on one side of the rotary trimmer 2, although in alternative embodiments, the paper guide can be present on both sides of the blade carriage guide 14 for securing a sheet material during the cutting (or trimming) operation from both sides of the central platform 12. The paper guide 64 is generally made of clear molded plastic or acrylic although other materials can be used. Further, the shape, size and orientation of the paper guide can vary.

It is further noted that the blade carriage 16 is employed particularly for interchangeably carrying one or more of the cutting blade(s) 67. The blade carriage 16 is slidably connected to the blade carriage guide 14 and includes an outer shell 66, a shaft (not shown) rotatably attached to the outer shell 66 and the cutting blade 67 rotatably mounted to the shaft. The outer shell 66 in particular is a hollow, substantially rectangular box with an open bottom for housing the shaft, and the circular blade within. The outer shell 66 has rectangular recess slots 68 through which the blade carriage 16 can be mounted to the blade carriage guide 14 formed on its opposing sides parallel to the blade carriage guide 14 to slidably rest on the grooves 54 of the blade carriage guide. To provide stable mounting of the blade carriage onto the blade carriage guide 14, and edge 55 of the recess slots 68 is contoured to the shape of the blade carriage guide. In other embodiments, other mechanisms of providing a tight and stable mounting of the blade carriage 16 onto the blade carriage guide 14 can be employed as well. The remaining two sides have formed thereon gradual recess slots 70 for providing a hand-grip portion to easily manipulate and/or guide the blade carriage 16 when mounted on the blade carriage guide 14. The hand-grip portion can be provided in a variety of different forms. For example, in other embodiments, palm pads or handles externally attached to the blade carriage can be present.

In the present embodiment, the outer shell 66 is made of molded plastic although in other embodiments, materials other than plastic can be used. Within the outer shell 66 is present a cutting blade, which can have any of a variety of shapes, sizes and/or configurations to provide a variety of different cutting operations and can be coated with coatings as described within Applicant's co-pending U.S. patent application Ser. No. 60/870,787, filed on Dec. 19, 2006 for CUTTING IMPLEMENT, patent application Ser. No. 11/231,259, filed Sep. 20, 2005 for COATING FOR CUTTING IMPLEMENT, and U.S. Pat. No. 6,988,318 filed on Nov. 24, 2003 and titled COATING FOR CUTTING IMPLEMENT, are all hereby incorporated by reference in their entirely herein, including any and all applications and patents related thereto. For example, in the present embodiment, the cutting blade is circular in shape having a sharp and rigid cutting edge for proving a smooth and even cut. In other embodiments, blades having a predefined cutting pattern or profile (e.g., a wave profile, a scalloped profile, a volcano profile, a bowtie profile, etc) or different types of blades such as those used for scoring paper can be used. Further, the cutting blade need not be circular in shape but can vary to convenience. The cutting blade can also have one or more apertures therein for cooperating with a mounting structure such as the shaft associated with blade carriage 16. Additionally, a biasing element (e.g., a metal spring) can act on the cutting blade within the blade carriage 16 when connected to the blade carriage guide 14 to influence the disposition of cutting blade with respect to the cutting platform to provide for a smooth cutting stroke. Advantageously, the shaft, the cutting blade and biasing element are all removable and can be easily replaced when worn out.

In particular and as indicated above, in at least some embodiments, the cutting blade 67 can be replaced. Specifically, the cutting blade 67 can be replaced by first removing one of the locking pins 28 by sliding that locking pin up and out of the respective end portion 15 or 17. Subsequent to removing the locking pin 28, the blade carriage guide 14 can be slid for example, about 6 inches, through the opening 26 from where the locking pin was removed. The blade carriage 16 can then be slidingly removed from the opposite end (e.g., the end portion opposite the end portion from where the locking pin 28*n* was removed) of the blade carriage guide 14 to replace the cutting blade 67 and/or any other component within the blade carriage. After replacing the cutting blade 67 and/or any other component, the blade carriage 16 can be slidingly mounted back onto the blade carriage guide 14 and the locking pin 28 can be slid back into the opening 26 to hold the blade carriage guide in position.

Referring now to FIG. 3, the bottom surface of the rotary trimmer 2 is shown, in accordance with at least some embodiments of the present invention. As indicated above, the first and second platforms 8, 10 have a flat bottom surface 32 pivotably attached to the trimmer housing 4. By comparison, the central platform 12 has a curvilinear bottom surface having strips of rubber pads 72 on the bottom surface 32, which provides slip resistance to the trimmer with respect to the surface on which the trimmer is placed. In alternative embodiments, a flat central platform or curvilinear first and second platforms can be present. In alternate embodiments, shapes and orientations other than those mentioned above can be present. Additionally, the rubber pads 72 can be present on the top surface of the cutting platform 6 as well to provide a non-slipping surface to the material being cut.

In operation, paper or other sheet material to be cut is inserted between the gap of the top surface of the cutting platform 6 and the bottom surface of the paper guide 64. The paper guide 64 secures the paper/sheet in position for an even and smooth cut. Specifically, the sheet to be cut and/or trimmed can be inserted from one side of the cutting platform 6 to extend beneath the paper guide 64 and through to the other side of the cutting platform to be in contact with the cutting blade 67. In general, the paper/sheet can be aligned in any direction and position with the aid of the grid units 42 and 48 between the paper stops 40. Subsequently, actuation (e.g., sliding) of the blade carriage 16 along a pre-defined path provides for a cutting operation via the cutting blade 67. In particular, a user can grasp the recessed portions 70 on the outer shell 66 of the blade carriage 16 to slide the blade carriage along the blade carriage guide 14 in both forward and backward directions. The sliding action rotates the shaft and the circular blade to facilitate a cutting action.

Particularly, in at least some embodiments, a method of operation of the rotary trimmer 2 is disclosed. The method of operation can encompass laying the rotary trimmer on a stable and flat surface for operation and then unfolding the trimmer in a working configuration. More particularly, the working configuration of the rotary trimmer 2 can be achieved by pivotably moving the first and the second platforms 8 and 10, respectively, outwardly and away from the base platform 12 until a contiguous and co-planar (or substantially co-planar) working surface is obtained. Subsequently, the blade carriage guide 16 can be slid over to one of the end portions 15 or 17 of the trimmer housing 4 for positioning paper or other sheet (or sheet-like) material to be trimmed and/or cut in a manner described above. After positioning the paper (or other sheet or sheet-like material), the paper guide 64 can be pressed down with one hand while the blade carriage 16 can be slid along the blade carriage guide 14 in one or both directions for trimming and/or cutting the material. Upon finishing trimming and/or cutting, the rotary trimmer 2 can be folded back into the storage configuration by folding the first and the second platforms 8 and 10, respectively upwardly towards the base platform 12.

By virtue of the cutting blade being biased in position within the outer shell 66 of the blade carriage 16 by the metal spring attached to the rotating shaft, a smooth and even cut through the paper is achieved. Furthermore, securing the paper/sheet by the paper guide 64 additionally aids in a smooth trimming and/or cutting operation. Typically, 10 sheets of 20 pound paper can be cut simultaneously in a single cutting operation. However, depending upon the embodiment, the number and density of sheets can vary. For example, in at least some alternative embodiments, the rotary trimmer 2 can be designed to cut in a range of about 7 to about 20 sheets of 20 pound paper each. In other embodiments, the above mentioned range can vary depending upon the cutting blade employed within the rotary trimmer and the clearance space available between the cutting platform 6 and the paper guide 64.

Furthermore, the dimensions of the rotary trimmer 2 can vary based at least in part upon the intended use. For example, although in the present embodiment, the first and the second platforms are sized substantially equal, in other embodiments this need not be the case. In other embodiments, each of the first and second platforms can be sized differently and the central portion 12 can be sized similar to or possibly even smaller (or larger) than each of the first and second platforms 8, 10. For example, in at least some embodiments, the dimensions of the rotary trimmer 2 can be as follows: the length of the trimmer between the trimmer housing members can be in a range of approximately 400 to 500 centimeters, the height of the trimmer from the base of the trimmer housing to the roof of the blade carriage 16 as seen from the side view of FIG. 4 can be in a range of about 70 to 100 centimeters and the width of the trimmer with both first and second platforms open can be in a range of about 200 to 300 centimeters. In other embodiments, the dimensions of the rotary trimmer 2 can vary to convenience.

Figure 8A:
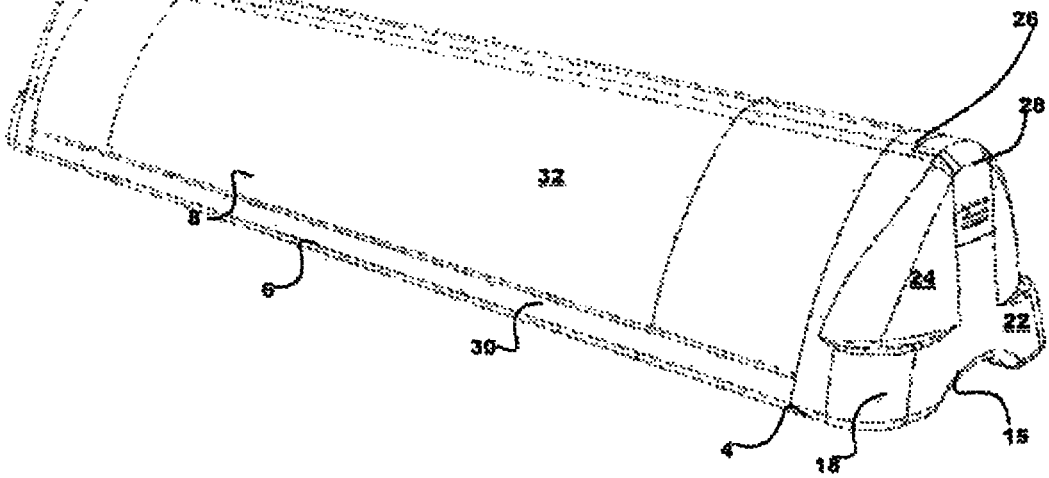
FIG. 8A is a perspective side view of an alternate rotary trimmer in a storage configuration, in accordance with at least some alternate embodiments of the present invention.
Figure 8B:
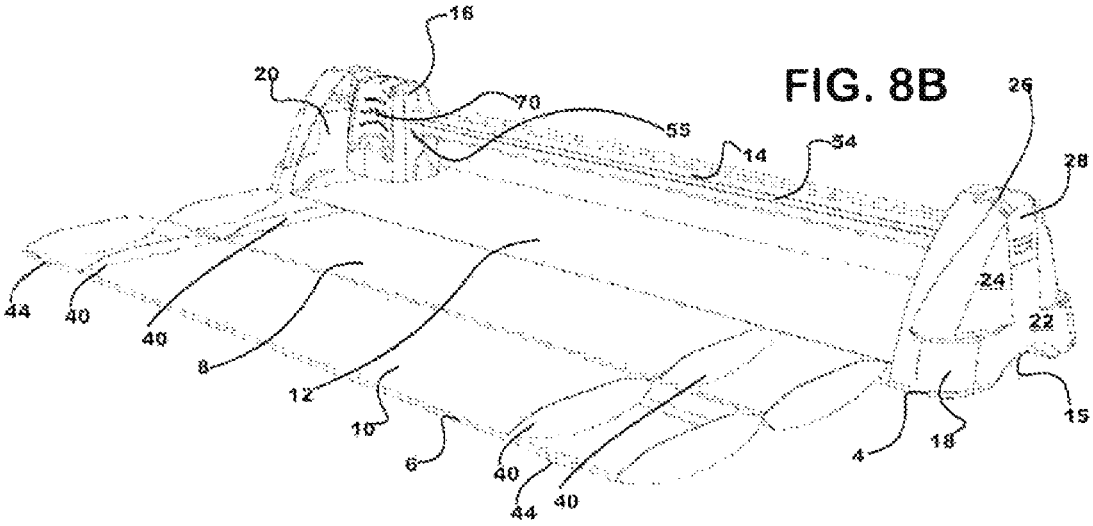
FIG. 8B is a perspective side view of the rotary trimmer of FIG. 8A in a working configuration, in accordance with at least some embodiments of the present invention.
Figure 8C:
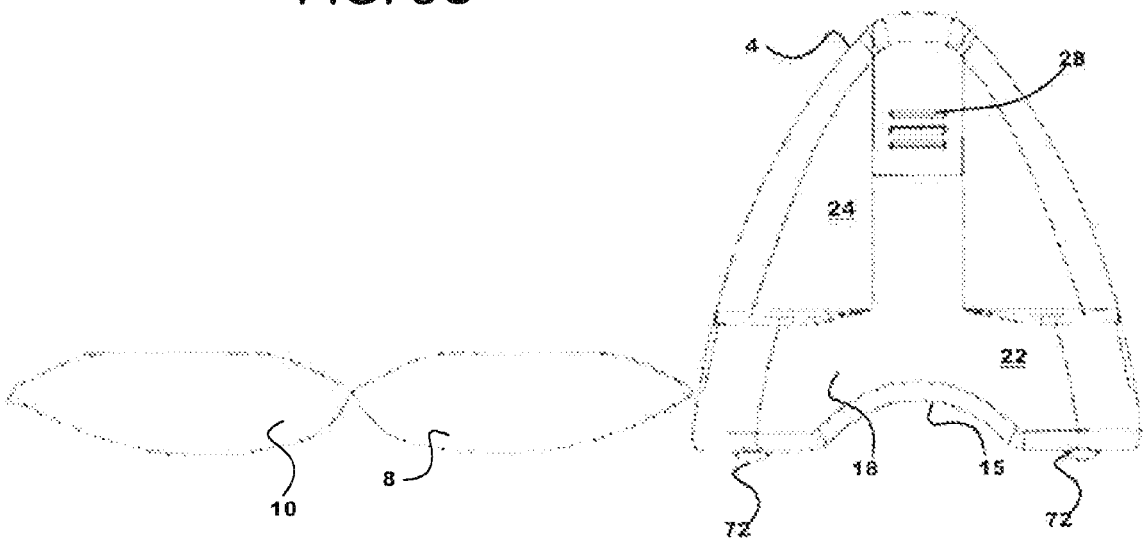
FIG. 8C is an end view of the working configuration of the rotary trimmer of FIG. 8B, in accordance with at least some embodiments of the present invention.

The present invention is intended to encompass a variety of alternative embodiments having one or more features differing from those described above. For example, as shown in FIGS. 8A-8C, an alternate embodiment of the rotary trimmer 2 of the present invention is shown, in accordance with at least some alternate embodiments of the present invention. As can be seen in FIG. 8B, both the first and the second platforms 8 and 10 of the cutting platform 6 are disposed on a single side of the central platform 12 in a working configuration. This is in contrast to the embodiment explained above in regards with FIGS. 1-6 in which the first and the second side platforms 8 and 10 are located on either sides of the central platform 12. The first and second platforms 8 and 10 in alternate embodiments can be pivotably attached to each other by way of pivots and/or rods such that the two portions of the side platform can go around and above the blade carriage guide 14 and the blade carriage 16 to engage with a locking mechanism on the other side. Further, as shown, the first and the second platforms 8 and 10 in this embodiment covers the blade carriage 16 as well and do not include indentations on the side platform for providing handles as shown in FIG. 8A. FIG. 8C shows the side view of the alternate embodiment of the rotary trimmer of FIG. 8B in the working configuration. In at least some other alternate embodiments, the size, shape, material and orientation of the individual components of the rotary trimmer can be varied. Additionally, the present invention is intended to encompass a wide variety of refinements of the above mentioned device, allowing for cutting/trimming sheets of material.

Notwithstanding the embodiments of the rotary trimmer 2 described above in relation to FIGS. 1-8C, other refinements to the features above including addition of various new features are encompassed within the scope of the present invention. For example, the sizes, shapes, orientations and the material of construction of the various components described above can vary from one embodiment to another. Also, the design of the various components can vary. Furthermore, it will be understood that the terms "pivotable", "pivotal", "pivoting" or similar terms are intended to have a broad meaning and encompass rotating, swinging, hinged or hinged-like and other similar movements.

Further, despite any method(s) being outlined in a step-by-step sequence, the completion of acts or steps in a particular chronological order is not mandatory. Further, modification, rearrangement, combination, reordering, or the like, of acts or steps is contemplated and considered within the scope of the description and claims.

It is specifically intended that the present invention not be limited to the embodiments and illustrations contained herein, but include modified forms of those embodiments including portions of the embodiments and combinations of elements of different embodiments as come within the scope of the following claims.

What is claimed is:

1. A rotary trimmer comprising:

a trimmer housing, the housing having: (i) a first end portion; (ii) a second end portion; and (iii) a cutting platform having: (a) a first platform; (b) a second platform; and (c) a base platform connected at least indirectly to at least one of the first and the second end portions, with the first and the second platforms pivotably connected at least indirectly to (1) the base platform; and/or (2) the first and the second end portions, said first and second platforms being pivotable between a working configuration and a portable configuration upwardly towards said base platform;

a blade carriage guide disposed between the first and the second end portions;

a manually moveable blade carriage having one or more cutting blades, the blade carriage slidably mounted to the blade carriage guide;

a strike bar operatively connected to the base platform and extending substantially the entire length of the base platform for aiding in the cutting and/or trimming operation; and a paper guide at least partially positioned on top of the strike bar for securing the material to be cut and/or trimmed in position on the cutting platform;

wherein the blade carriage can be slid along the blade carriage guide to cut and/or trim a sheet or sheet-like material positioned on the cutting platform.

2. The rotary trimmer of claim 1, wherein the first platform, the second platform and the base platform are at least substantially co-planar when said first and second platforms are in their working configuration to form a substantially contiguous working surface.

3. The rotary trimmer of claim 1, wherein the trimmer is re-configurable.

4. The rotary trimmer of claim 3, wherein the first and the second platforms each form an angle that is about 30 degrees to about 60 degrees with respect to the base platform when in their portable configuration.

5. The rotary trimmer of claim 3, wherein the first and the second platform are co-planar or substantially co-planar with respect to the base platform when in their working configuration.

6. The rotary trimmer of claim 1, wherein each of the first and the second platforms further comprises:

a first surface having (i) a pair of paper stops for positioning the material to be cut and/or trimmed therebetween; and (ii) a ruler defined between the pair of paper stops for measuring the material to be cut and/or trimmed; and a second surface opposite the first surface, the second surface having at least one support structure extending therefrom for providing stability to the trimmer during operation.

7. The rotary trimmer of claim 1, wherein the blade carriage is readily removable from the blade carriage guide and the blade carriage guide is readily removable from the first and the second end positions.

8. The rotary trimmer of claim 1, wherein the blade carriage guide extends parallel or substantially parallel to the base platform.

9. The rotary trimmer of claim 1, wherein the blade carriage guide is connected to the first and the second end portions of the trimmer housing by way of a pair of releasable locking pins.

10. The rotary trimmer of claim 1, wherein each of the first and the second platforms are disposed on opposing longitudinal sides of the base platform and pivotably connected to (a) the base platform; and/or (b) the first and the second end portions.

* * * * *